United States Patent [19]

Stewart et al.

[11] 4,219,981

[45] Sep. 2, 1980

[54] REINFORCING STRUTS FOR ROOFING TILES

[75] Inventors: James L. Stewart; Raymond G. Owers, both of Auckland, New Zealand

[73] Assignee: Ahi Operations Limited, Auckland, New Zealand

[21] Appl. No.: 941,052

[22] Filed: Sep. 11, 1978

[30] Foreign Application Priority Data

Sep. 19, 1977 [NZ] New Zealand ..... 185207

[51] Int. Cl.[2] ..... E04D 3/30

[52] U.S. Cl. ..... 52/478; 52/529; 52/553

[58] Field of Search ..... 52/478, 470, 471, 472, 52/460, 529, 553

[56] References Cited

U.S. PATENT DOCUMENTS

| | | | |
|---|---|---|---|
| 1,076,065 | 10/1913 | Roth | 52/472 |
| 2,520,499 | 8/1950 | Golaz | 52/471 X |
| 3,339,333 | 9/1967 | Kovalak | 52/531 X |
| 3,373,534 | 3/1968 | Berridge | 52/478 X |
| 3,380,214 | 4/1968 | Stevens | 52/478 |
| 3,629,988 | 12/1971 | Zylstra | 52/542 X |
| 4,058,949 | 11/1977 | Bellem | 52/478 X |

FOREIGN PATENT DOCUMENTS

| | | | |
|---|---|---|---|
| 746203 | 11/1966 | Canada | 52/478 |
| 151738 | 5/1904 | Fed. Rep. of Germany | 52/478 |
| 12142 | 8/1903 | Norway | 52/478 |
| 348155 | 5/1931 | United Kingdom | 52/478 |

*Primary Examiner*—Alfred C. Perham
*Attorney, Agent, or Firm*—McWilliams, Mann & Zummer

[57] ABSTRACT

A roof is provided with a plurality of reinforcing struts spanning tile battens. The reinforcing struts are of top hat cross-section and are provided with a stepped locating tab at one end to enable a sequence of struts to be laid in stepped formation to accurately locate side channels on stepped roofing tiles.

2 Claims, 3 Drawing Figures

Figures 1, 2, 3:
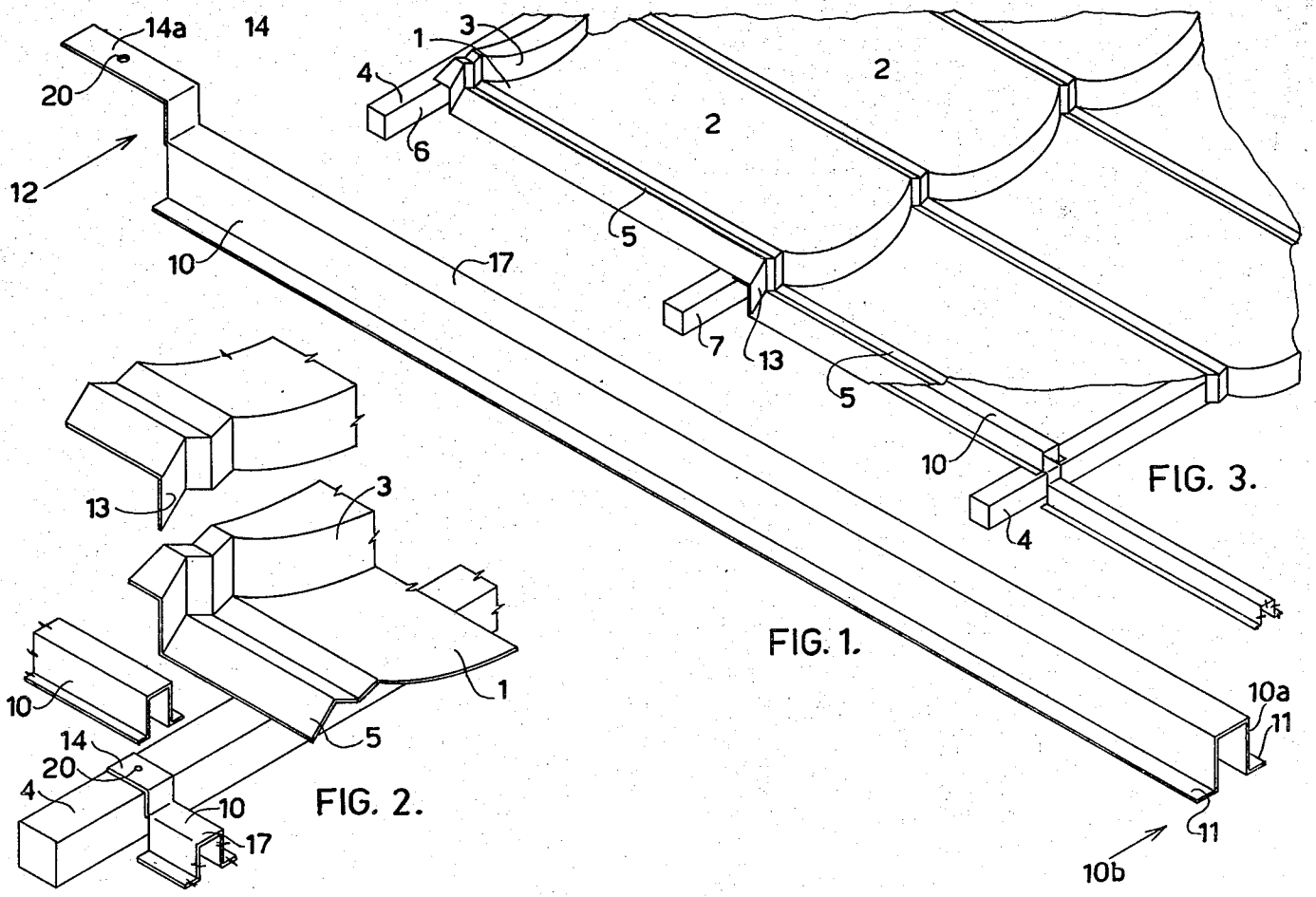

1
2
3
4
5
6
7
10
10a
10b
11
12
13
14
14a
17
20

REINFORCING STRUTS FOR ROOFING TILES

This invention relates to the reinforcing and stiffening of tiles, cladding and the like. The invention will be described by way of example only with reference to tiles. It should be appreciated however that the invention also has application to cladding and the like.

It is well known to provide roofing tiles constructed for example of metal or ceramic materials, and which span spaced apart battens such as for example on the roof of a construction, so as to form a tile roof. It is usual for such roofing tiles to span spaced apart battens (for example roofing battens), and there is therefore a portion of the tile which is unsupported and extends between adjacent battens. These tiles when used in certain countries and in certain local authority areas, meet with the objection that they have unsupported, or unstiffened areas which do not meet the requirements of certain countries and local bodies.

Various roofing struts have been proposed for use between battens or purlins to support tiles or shingles. For example, U.S. Pat. No. 3,373,534 to Berridge and U.S. Pat. No. 3,380,214 to Stevens both suggest metal clips for attachment to specially shaped metal purlins to provide reinforcement for metal shingles. Not only do these struts or clips require specially shaped end portions and specially shaped metal purlins, but they are provided in a staggered relationship on the purlins and are so shaped as to be suitable for metal shingles having flat undersides.

However, in the case of metal tiles having shaped surfaces and stepped leading and trailing edges, the location of reinforcing struts should coincide with particular portions of the tiles. It is therefore necessary to accurately locate the reinforcing struts on the tile battens.

It is an object of this invention to go someway towards overcoming these problems in providing an improved reinforcing strut.

According to one aspect of this invention there is provided a reinforcing strut for roofing tiles wherein the strut includes an elongate channel member having an upturned flange at one end thereof and a locating tab on said flange extending away from the channel member, the other end of the channel member being open to receive a tab of an adjacent reinforcing strut.

According to a further aspect of this invention, there is provided a roof including; a plurality of spaced apart tile battens extending across the roof; a plurality of reinforcing struts connected to said tile battens; each reinforcing strut consisting of an elongate channel member having one open end and an upturned flange at the other end, and a locating tab on said flange extending away from said channel member; the reinforcing struts being connected to said tile battens in stepped formation with each locating tab being connected to an upper surface of a tile batten, with adjacent reinforcing struts being positioned in line by interengagement of adjacent locating tabs and open ends; and a plurality of tiles being positioned on said roof in stepped formation over said reinforcing struts and tile battens, each tile having a leading edge extending over a tile batten, and a trailing edge extending over the upturned flange and locating tab of said reinforcing member.

The invention will now be described by way of example only, with reference to the accompanying drawings, in which.

FIG. 1: is a view of a reinforcing strut.

FIG. 2: is an exploded view of tile, batten and strut.

FIG. 3: is a view of a plurality of tiles, battens and struts.

The invention relates to the reinforcing or stiffening of tiles 1 (such as for example only, those tiles known by the trade mark "Decramastic"), which are provided with a main body portion 2, an upwardly stepped top portion or trailing edge 3 and a downwardly stepped lower portion or leading edge 13. Such tiles are known as to engage with adjacent and spaced apart battens 4 for example the battens in the framing of a roof. Such tile battens may be rectangular as shown, or trapezoided to vary the slope of the tiles with respect to the slope of rafters. This is by way of example only however, and the invention has equal application to the tiles or cladding which may be used on walls or other structures.

The tiles are provided adjacent each side thereof, with one or more substantially channel type recesses or formations 5. In use, the tiles 1 engage with the adjacent and spaced apart battens 4 in a step like engagement, (FIG. 3), the upwardly turned top end 3 engaging over and being secured to an upper batten 6 and the downwardly turned lower end 13 engaging with and being secured to a spaced apart lower batten 7.

As stated hereinbefore, problems have arisen with such tiles in that the tiles spanning the battens have been stated to be unreinforced or stiffened, and of inadequate standard to meet the requirements of certain countries and local bodies.

The invention provides an elongate support or stiffening member or strut 10 in the form of an elongate member of suitable material, such as for example metal, plastics, wood and the like. It should be appreciated that these materials have equal advantage and the invention is in no way limited to the elongate stiffening member being formed of any particular material. Although it is generally convenient to form the struts of metal.

The reinforcing or stiffening strut 10 is in one form of the invention, formed as a substantially "top hat" or "omega" cross-section, being of a substantially inverted channel section, having the lower ends of the arms turned or bent outwardly at substantially right angles to the longitudinal axes of the arms **10*a* so as to form flanges 11** and thus to form the substantially "top hat" or "omega" cross-section (FIG. 1).

Adjacent at least one end 12 of the strut is provided a location member 14 which is substantially "L" shaped and which is engaged either integrally or separately with the end 12 of the strut 10. As will be appreciated from the accompanying drawings, the location member 14 is formed or attached to the strut 10 so as to have a flange stepped upwardly from the upper surface 17 of the strut 10 and a locating tab **14*a* extending away from channel section. Conveniently tab 14*a* can be parallel to the upper surface 17**, of the channel section.

In use, where tiles 1 are being mounted as for example on a roof, between adjacent battens 4, a strut 10 is engaged with each side of each tile; for example the strut 10 is engaged within the recess or channel provided at each side of the tile. The flanges 11 of the strut 10 adjacent the butt end **10*b* thereof, engage with the upper surface of a batten 4 and the strut 10 then runs the length of the tile 1 (substantially parallel to the longitudinal axis thereof) and is engaged with an upper and spaced apart batten, by the securing or locating tab engaging over the upper surface of the batten and being secured in position by a nail or some suitable other securing means, passing through a hole 20 in the surface engagement portion 14***a* thereof. This then holds the strut 10 in position relative to the tile or tiles and to the batten or battens, and provides a reinforcing or stiffening to the tile. Struts can be laid in stepped formation by locating the butt end 10*b* of one strut over the locating tab 14*a* of the preceding strut. Thus the struts can be readily aligned and tiles laid over the struts.

The invention has been described with reference to a reinforcing strut being provided at each side of each tile, however if desired, only one stiffening strut can be provided with each tile.

It will be appreciated that this invention has been described by way of example only and that improvements and modifications may be made without departing from the scope of the invention as set forth in the following claims. The claims form part of the description.

We claim:

1. A reinforcing strut for roofing tiles wherein the strut includes an elongate channel member of top-hat cross section having an upper face, two downwardly depending sides, and side flanges extending outwardly from said sides, and an upturned flange at one end of the upper face thereof, a locating tab on said flange substantially parallel to said upper face and extending away from said upper face thereof, the other end of the channel member being open to receive a tab of an adjacent reinforcing strut.

2. A roof including: a plurality of spaced apart tile battens extending across the roof; a plurality of reinforcing struts connected to said tile battens; each reinforcing strut consisting of an elongate channel member of top-hat cross section having an upper face, two downwardly depending sides, and side flanges extending outwardly from said sides, and an upturned flange at one end of the upper face thereof, a locating tab on said flange substantially parallel to said upper face and extending away from said upper face thereof, the other end of the channel member being open to receive a tab of an adjacent reinforcing strut; the reinforcing struts being connected to said tile battens in stepped formation with each locating tab being connected to an upper surface of the tile batten, with adjacent reinforcing struts being positioned in line by inter-engagement of adjacent locating tabs and open ends; and a plurality of tiles each tile having stepped leading and trailing edges and recesses adjacent their side edges; said reinforcing struts being spaced apart to coincide with said recesses adjacent the side edges of said tiles; said tiles being attached to said roof and positioned with their side edges overlapping and supported by said struts coinciding with said recesses; the trailing edge of each tile resting on a tile batten and covering the locating tabs of said struts, and the leading edge of each tile extending over the open ends of said struts and covering the trailing edge of the next adjacent tile.

* * * * *